United States Patent [19]

Kastner et al.

[11] 3,997,994

[45] Dec. 21, 1976

[54] SHOULDER ARM WITH SWIVEL BREECH MEMBER

[75] Inventors: Günter Kästner; Dieter Ketterer; Tilo Möller, all of Oberndof; Ernst Wössner, Sulz-Muhlheim, all of Germany

[73] Assignee: Heckler & Koch GmbH, Oberndorf, Germany

[22] Filed: Mar. 11, 1975

[21] Appl. No.: 557,375

[30] Foreign Application Priority Data

Mar. 21, 1974 Germany ..... 2413615

[52] U.S. Cl. ..... 42/9; 42/39.5

[51] Int. Cl.[2] ..... F41C 11/00

[58] Field of Search ..... 42/9, 15, 39.5, 59, 42/60; 89/33 MC, 4 A, 13 R, 17, 126, 155, 156

[56] References Cited

UNITED STATES PATENTS

| | | | |
|---|---|---|---|
| 10,520 | 2/1854 | Cook | 42/9 |
| 38,772 | 6/1863 | Underwood | 42/9 |
| 39,232 | 7/1863 | Howard | 42/9 |
| 1,294,636 | 2/1919 | Dovell | 89/33 MC |
| 2,976,770 | 3/1961 | Fletcher | 89/155 |

FOREIGN PATENTS OR APPLICATIONS

| | | | |
|---|---|---|---|
| 73,513 | 9/1944 | Czechoslovakia | 42/9 |
| 5,564 | 12/1881 | United Kingdom | 42/59 |
| 10,944 | 8/1884 | United Kingdom | 42/9 |

*Primary Examiner*—Charles T. Jordan
*Attorney, Agent, or Firm*—Spencer & Kaye

[57] ABSTRACT

A shoulder arm, such as a rifle, having a breech member which can be swivelled about an axis which is perpendicular to the axis of the barrel for loading the breech member contains a firing chamber which is in alignment with the barrel in is firing position and which is closed to the rear. The shoulder arm has an arrangement for swivelling the breech member out of the firing position and into a loading position, in which said firing chamber is accessible for the introduction of a cartridge. The breech member is designed as a roller which can be swivelled about its longitudinal axis and which is arranged in a cylindrical hole in a member which is fixedly attached to the barrel and whose wall directly closes the firing chamber when it is located in the firing position. The wall is retained in its respective position by means of the arrangement for swivelling the breech member.

19 Claims, 2 Drawing Figures

SHOULDER ARM WITH SWIVEL BREECH MEMBER

Figure 1:
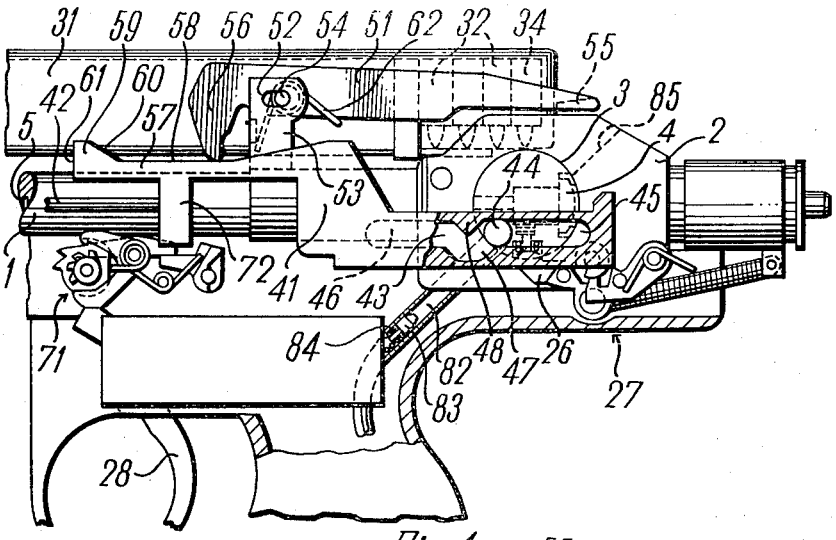

The present invention relates to a shoulder arm, especially a rifle, having a breech member which can be swivelled about an axis which is perpendicular to the axis of the barrel for loading and which contains a firing chamber which is in alignment with the barrel in its firing position and which is closed to the rear, further having an arrangement for swivelling the breech member out of the firing position and into a loading position, in which the firing chamber is accessible for the introduction of a cartridge.

A shoulder arm of this type is known from Swiss Pat. No. 541,792. This is a shotgun, in which the barrel is followed by a breech member which contains the firing chamber, which can be shifted longitudinally relative to the barrel and which can be swivelled; a locking plate which is also slidable; and a crossbolt which can be shifted and swivelled. With the weapon ready to fire, a plane end surface of the breech member, which contains the firing chamber, is in a contacting relationship with the rear end of the barrel and that portion of the receiver containing the barrel; two engagement bolts attached to the end surfaces engage corresponding apertures in the receiver. A locking plate 40 is pressed against the rear end of the breech member by the crossbolt, and its bevelled, projecting edges are in a supporting relationship with corresponding bevelled surfaces on the rear of the breech member. This locks the breech member in the firing position. To open the breech arrangement, the crossbolt is first swivelled, which eliminates the blocking condition of the locking plate; the crossbolt, the locking plate and the breech member are then pushed rearwardly into positions which permit the breech member to swivel freely. In the known weapon, the firing pin is arranged coaxially to the firing chamber in the firing position and comprises three members, of which a forward member is arranged in the slidable locking plate, a center member is arranged in the swivel crossbolt and a rear member is arranged in a stationary portion of the receiver which is located directly behind the crossbolt.

Although the arrangement of a swivel breech member containing the firing chamber offers many advantages over other loading and breech mechanisms in shoulder arms, it can be seen that, as a result of the employment of a large number of moving parts and a divided firing pin, the design of the known arrangement is relatively complicated, which results in considerable cost and can easily lead to malfunctions, with the result that the question arises of whether the advantages of a swivel breech member of this type are not outweighed by its disadvantages, and whether the employment of a breech member of this type does not, in the final analysis, appear to have little sense.

It is therefore the object of the present invention to design a shoulder arm, of the type described at the outset, having a swivel breech member, in such a manner as to achieve a very simple and dependable design, which also results in a high degree of dependability, so that the advantages of the employment of a swivel breech member can be utilized in full and are not outweighed by the disadvantages of a complicated design.

According to the present invention, this object is solved in that the breech member is designed as a roller which can be swivelled about its longitudinal axis and which is arranged in a cylindrical hole in a member which is fixedly attached to the barrel and whose wall directly closes the firing chamber when it is located in the firing position, the wall being retained in its respective position by means of the arrangement for swivelling the breech member.

In the shoulder arm according to the present invention, there is only one single moving part, i.e. the breech member itself, and this single moving part is designed as a simple, swivel roller, for which merely a cylindrical hole must be provided in the member which is fixedly attached to the barrel. This makes the design of the shoulder arm according to the present invention extremely simple, while simultaneously achieving a high degree of dependability. In addition, it is also possible to keep the moving masses very small, so that no large forces are required for moving them, which means that no large forces must be exerted for loading the weapon. This is not only of significance if the weapon is of the manually loaded type, but especially if the weapon is of the semi-automatic or fully automatic type. The arrangement according to the present invention is also suitable for weapons of this type. Especially in cases where the breech member must be moved very quickly in automatic weapons, it is of significance for the axis of the firing chamber to intersect the axis of the roller forming the breech member, as it is then especially easy to ensure that the roller is at least approximately balanced in both the loaded and unloaded states, so that the bearing means do not have to be subjected to especially high forces. Moreover, when the cartridge is ignited, the gas pressure does not result in any momentum which could have a tendency to swivel the roller out of place, so that the arrangement for swivelling the breech member is also not subjected to any large forces during operation either.

As already mentioned above, the weapon which is known from Swiss Pat. No. 541,792 is a shotgun. In this shotgun, the firing chamber is designed in such a manner that, when the weapon is fired, the front end of the cartridge case covers the gap between the firing chamber and the section of the barrel located directly in front thereof, thereby sealing it. However the arrangement according to the present invention is intended for use with any and all types of ammunition. It is therefore sufficient for the breech member to be matched precisely to the cylindrical hole and for the firing chamber to have a rear section of wider diameter, so that the powder gases act on a rearwardly extending shoulder in the firing chamber, thereby pressing the breech member tightly against the rear end of the barrel.

The shoulder arm according to the present invention is especially well suited for firing caseless cartridges, which do not leave any remains, which would have to be ejected, in the firing chamber after the cartridge is fired. However if caseless cartridges are employed, there is no cartridge case for sealing that end of the firing chamber facing the barrel. If the firing chamber is designed to receive caseless cartridges, it would thus also be necessary to provide sealing means at the rear end of the firing chamber as well. These sealing means could be a lip seal limited by an annular groove, which forms a type of obturation and which is pressed gas-tight against the rear wall of the cylindrical hole by the pressure of the powder gases. In a preferred embodiment of the invention, however, the area for receiving the propellant body of a caseless cartridge has a wider rear section, in which is inserted a sealing sleeve whose inwardly extending flange is in a contacting relationship with the wall of the member which is fixedly attached to the barrel. A sealing sleeve of this type ensures especially good sealing. The wider rear section of the area serving to receive the propellant body can simultaneously serve as a compensation area for preventing an excessively fast increase in pressue when a cartridge of this type is ignited.

If caseless ammunition is employed, it is also possible for a firing pin, pointing at right angles to the axis of the firing chamber, to be arranged in the area serving to receive the propellant body in the breech member. The employment of a firing pin of this type offers the possibility of arranging a priming compound in a side surface of the propellant body of the caseless cartridge in a location in which the priming compound can still be in a supporting relationship with that portion of the bullet which extends into the propellant body. This provides the priming compound with a solid support, which ensures proper ignition of the cartridge.

In a further development of the invention, in addition to the firing position and the loading position, the breech member can also be swivelled into an ejection position, in which the rear end of the firing chamber is free and the front end faces a passage provided in the receiver of the shoulder arm for an ejector. An arrangement of this type is practical with both case-type cartridges and caseless cartridges in order to offer a possibility for ejecting jammed cartridge cases or unignited cartridges. In this connection, the ejector can be a separate rod which can be inserted into the passage or means which are arranged within the passage.

The arrangement for swivelling the firing chamber can comprise a slide which is arranged in the longitudinal direction of the weapon and which engages the breech member positively in each of the positions of the slide. For this purpose, in an especially simple manner the breech member can have an eccentric stub engaging a control slot in the slide. In order to ensure that the breech member always assumes the desired loading or firing position precisely, without requiring the slide to also assume a precisely desired position, in a preferred embodiment of the invention the control slot has two end sections extending parallel to its direction of movement, one of the end sections defining the firing position and the other of the end sections defining the loading position, each of the end sections being connected one with the other by means of a transition which causes the breech member to rotate. In this connection, again, it is especially advantageous if, in the loading and firing positions, the stub of the breech member assumes one respective position of two preferably symmetrically located positions in the direction of travel of the slide, located on both sides of the perpendicular extending through the swivel axis of the roller, and the transition between the two end sections is designed as a vee. With an arrangement of this type, the direction of movement of the stub of the breech member in its two end positions forms the largest angle with the direction of movement of the slide, which results in the highest possible degree of accuracy in positioning the breech member.

In single-shot weapons, the slide can be actuated manually. However it is preferable if the slide is connected with drive means which are actuated by gas pressure. An arrangement of this type is not only of interest for automatic shoulder arms, but even for single-shot weapons, as in this manner it is possible for the gas pressure to be utilized for opening the breech arrangement, i.e. for placing the breech member in the loading position, and for simultaneously cocking the trigger mechanism. In both single-shot and autoloading weapons, it is especially advantageous if the drive means operate conjointly with the trigger mechanism in the nature of an open-bolt weapon, i.e. for the breech mechanism to be caught in the loading position after every shot, so that the breech member is either prepared for the manual introduction of a cartridge or, in automatic weapons, to prevent a cartridge from being introduced into the hot barrel after a burst and being ignited there unintentionally as a result of the high temperature. In a further development of the present invention, in the loading position, the breech member can be swivelled at least almost 90° relative to the firing position, and there is a magazine in which the cartridges are arranged perpendicular to the direction of fire and in which the respective forwardmost cartridge is located opposite the firing chamber when the breech member is located in the loading position. The cartridges can be introduced into the firing chamber from a magazine of this type either individually by hand or automatically by means of a simple slide or lever arrangement. In this connection, either box-type or drum magazines can be employed. However in either case it is advantageous to be able to arrange magazines of this type flatly on the weapon, as the stack of cartridges is located in a plane which is parallel to the barrel of the weapon. In an advantageous embodiment of the present invention, a box-type magazine is employed which is arranged above the barrel and parallel thereto. This permits magazines having a relatively high capacity to be arranged very compactly. In addition, attachment to the barrel also makes it easily possible to mount the barrel with the breech mechanism in a receiver, as the magazine can readily move along with the barrel.

In a preferred embodiment of the invention, to eject cartridges from the magazine and introduce them into the breech member a loading lever is pivotally mounted about an axis which is parallel to the swivel axis of the breech member, a shoulder of the loading lever engaging the respective forwardmost cartridge in the magazine from behind in one position and pushing the cartridge out of the magazine and into the breech member, located in the loading position, by means of a swivel motion. In order to automate the loading operation, it is advantageous for the loading lever to operate conjointly with a cam which is connected with the slide which causes the breech member to swivel. In this connection, the loading lever can be designed in such a manner that it retains the second forwardmost cartridge in its original position while the forwardmost cartridge is being inserted into the breech member and until the loading lever has returned to its initial position, so that the retained cartridge can only then advance to the forward most position. In a preferred embodiment of the invention, however, the loading lever is slidably arranged in its longitudinal direction and is subjected to the force of an elbow spring, which retains it in a position of rest, in which the shoulder is positioned both beside and behind the forwardmost cartridge in the magazine. In this connection, the cam on the slide pushes the loading lever out of the position of rest, against the force of the elbow spring, and first into that position in which the shoulder engages the forwardmost cartridge from behind before the cam swivels the loading lever to push the cartridge into the breech member and then releases the loading lever directly thereafter, permitting it to return to its position of rest, so that the shoulder of the loading lever passes by the forwardmost cartridge in the magazine as the loading lever swivels back into its position of rest. This arrangement provides the advantage that there is more time available for moving the stack of cartridges and placing the forwardmost cartridge in a position which is suitable for its introduction into the breech member. Since the stack of cartridges has a relatively high mass and the generally employed follower springs cannot be designed too strongly, a relatively long period of time is required for advancing the cartridges, so that the above described measure permits the rate of fire of a weapon of this type to be increased or, with a high rate of fire, the dependability to be improved.

The ejection position of the breech member is advantageously located between the loading and the firing positions, and, when the breech member is located in the ejection position, the loading lever assumes an intermediate position, in which the shoulder thereof is located outside of the path of a portion of the cartridge which is to be ejected.

Figure 2:
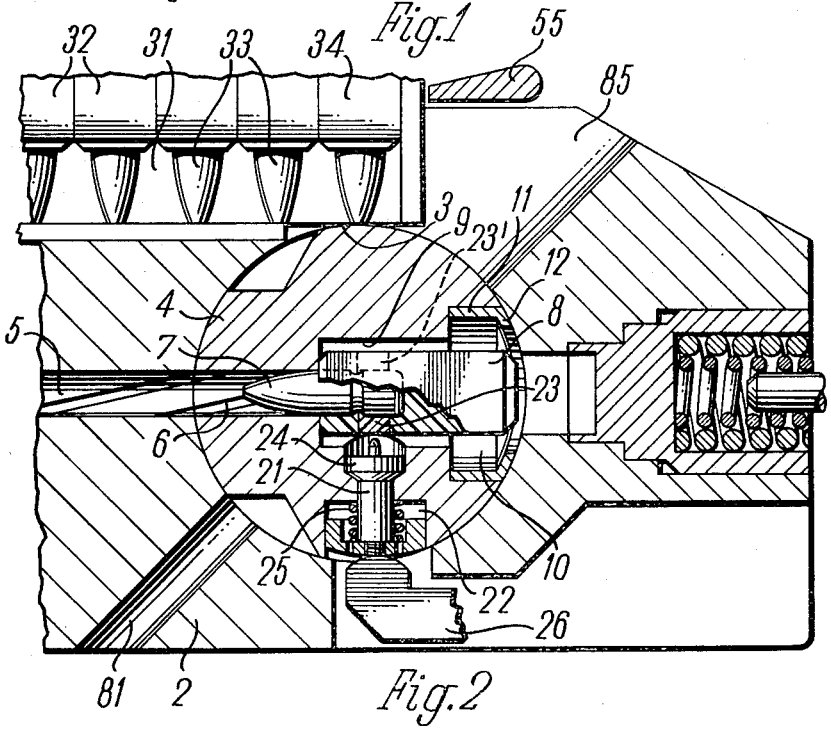

The above discussed and other objects, features, advantages and embodiments of the present invention will become more apparent from the following description thereof, when taken in connection with the practical example shown in the accompanying drawings. The features contained in the description and drawings may be employed in other embodiments individually or in any desired combination. In the drawings, FIG. 1 shows the parts of an automatic rifle of significance for the invention, partially as a side view and partially as a section; and FIG. 2 shows a longitudinal section through the breech member, and the components adjacent thereto, of the rifle shown in FIG. 1, in a larger scale.

Referring now to the drawings, wherein like reference numerals designate like parts throughout the several views, the practical example shown therein is an automatic rifle equipped for firing caseless cartridges. Located in a member 2 which is fixedly attached to the barrel 1 is a cylindrical hole 3, whose axis extends perpendicular to the axis of the barrel and intersects said axis of the barrel. Mounted in this hole in a roller-shaped breech member 4, which can be pivoted about the axis of hole 3. This breech member is illustrated in the firing position in the drawing. In this firing position, a firing chamber arranged in the breech member is in alignment with the bore 5 of barrel 1. The firing chamber has a front section 6 for receiving the tip of the bullet 7, which projects from the propellant body 8 of a caseless cartridge inserted in the firing chamber. Propellant body 8 is located in an area 9 of the firing chamber which has a larger diameter than section 6, which serves to receive the bullet. The front end surface of propellant body 8 is in a contacting relationship with the shoulder formed by the transition between area 9 and section 6 of the firing chamber. Area 9 for receiving propellant body 8 has a wider rear section 10, in which a cylindrical sealing sleeve 11 is inserted. The rear end of this sealing sleeve has an inwardly extending flange 12, which is in a contacting relationship with the wall of member 2, which is fixedly attached to the barrel, in the firing position. When a cartridge is ignited, flange 12 is pressed firmly against the wall of member 2, which is fixedly attached to the barrel, by the gases produced, thereby providing secure sealing of the firing chamber to the rear.

In order to produce a gas-tight transition between front section 6 of the firing chamber and bore 5 of the barrel as well, the configuration of breech member 4 is matched precisely to that of hole 3 in member 2. The pressure of the powder gases, acting on the shoulders between section 6 and area 9, as well as between area 9 and rear section 10 of the firing chamber, then presses that section of breech member 4 surrounding the outer end of front section 6 of the firing chamber firmly against that section of member 2 surrounding bore 5 of the barrel, thereby providing a gas-tight transition from the firing chamber to bore 5 of the barrel.

It would be readily possible to employ a known firing pin arrangement, in which the firing pin strikes the rear end surface of the cartridge in the conventional manner, in a shoulder arm designed in accordance with the present invention. An arrangement of this type would also be necessary with casetype cartridges. Cartridges of this type would also be readily employable, as a deformation of the case head, caused by the cylindrical wall of member 2, which could occur under the effect of the powder gases, can be accepted. However in the illustrated practical example, which is equipped for caseless cartridges, a firing pin 21 is arranged in a hole 22, extending perpendicular to the firing chamber, in breech member 4, so that firing pin 21 is aligned at right angles to the axis of the firing chamber. The tip of firing pin 21 is located opposite a side surface of propellant body 8 of a cartridge, having a rectangular cross section, located in breech member 4 in such a location that it is also located opposite that section of bullet 7 which extends into propellant body 8. Embedded in propellant body 8 at this point is a priming compound 23. This priming compound extends to the bullet, thereby being in a sort of supporting relationship with the bullet, so that when struck by firing pin 21 the force of firing pin 21 is fully utilized and ensures dependable ignition. With a rectangular cross section of propellant body 8, there is a second priming compound 23°on the side of propellant body 8 facing away from the firing pin, so that the cartridge can be inserted into the firing chamber in each of the two attitudes possible with a rectangular cross section of the propellant body and ignition is always ensured. Firing pin 21 has a wider head 24, which has a rearward tapered surface which is in a contacting relationship with a corresponding mating surface in hole 22 of breech member 4 under the force of firing pin spring 25 in the position of rest of the firing pin, thereby sealing the firing chamber. Firing pin 21 is struck out of this position of rest to ignite a cartridge by a hammer 26, which operates conjointly with members of a trigger mechanism 27 (FIG. 1) in the conventional manner, whereby the members of trigger mechansim 27 are, themselves, in an unillustrated operative connection with the trigger 28.

For loading the weapon, breech member 4 can be swivelled 90°into a loading position, in which the firing chamber in FIG. 2 is vertical and its rear end, containing area 9 for receiving propellant body 8 of a cartridge, faces upward toward a magazine 31, which is arranged above barrel 1 of the weapon and extends parallel to said barrel. Magazine 31 is a box-type magazine in which cartridges 32 are arranged in such a manner that they are perpendicular to the direction of fire, with the bullet tips 33 pointing toward the axis of the barrel. With breech member 4 in the loading position, the respective forwardmost cartridge 34 is aligned with the firing chamber in the breech member.

Breech member 4 is swivelled by means of a slide 41, which is slidably mounted in the longitudinal direction of the weapon and which is connected with unillustrated drive means, actuated by means of the gas pressure by means of a rod 42. Slide 41 has a control slot 43, in which an eccentric stub 44, attached to the end surface of breech member 4, engages positively. Control slot 43 comprises two end sections 45 and 46, which extend parallel to its direction of travel and which are connected one with the other by means of a V-shaped transition 47. As can be seen, stub 44, and thus breech member 4, is retained in a defined position independently of the position of slide 41 as long as stub 44 is located in the area of one of end sections 45 or 46 of control slot 43. Consequently, the breech member is positioned precisely, without slide 41 having to assume precisely defined end positions. This characteristic of the above-described arrangement is of significance especially if the loading operation is controlled by the gas pressure, as the forces occurring, and consequently the movements caused by these forces, can be subject to considerable variations, which must not affect the operation of the weapon.

In the arrangement according to FIG. 1, stub 44 of breech member 4 is located in rear end section 45, with the breech member being retained in the firing position. When slide 41 is now moved rearwardly by the gas pressure after a shot is fired, projection 48 on the upper edge of control slot 43, which belongs to V-shaped transition 47, strikes stub 44 and drives it along rearwardly. Consequently, breech member 4 performs a counterclockwise rotation, during which stub 44 travels through the V-shaped transition until the stub enters front end section 46 of control slot 43. Breech member 4 has then performed a 90°rotation and has been placed in the above-mentioned loading position. When the slide travels forward, the rotation is performed in the opposite sense. Since both end sections 45 and 46 of control slot 43 are aligned one with the other, stub 44 of breech member 4 assumes two end positions, located symmetrically to a plane extending through the pivot axis of the roller and perpendicular to the direction of travel of the slide and the direction of end sections 45 and 46. As can further be seen, the motion of breech member 4 is caused exclusively by control slot 43, and the breech member is retained in its end positions exclusively by the positive engagement of stub 44 in control slot 43. Since the axis of the firing chamber intersects the axis of the roller forming the breech member, the forces occurring as a result of the gas pressure when a cartridge is fired act symmetrically upon the breech member, so that there are no torques whatsoever and no significant forces are required for retaining the breech member. Consequently, no complicated locking means are required for the breech member either.

A loading lever 51, which is mounted slidably in the longitudinal direction of magazine 31 in a slot 52, which is parallel to magazine 31, in a stationary bearing member 53 and which is mounted pivotally about an axis which is parallel to the axis of breech member 4, serves to introduce cartridges 32 from magazine 31 into the firing chamber of breech member 4, which is located in the loading position. An elbow spring acting on loading lever 51 and on bearing member 53 attempts to swivel the loading lever counterclockwise and retain it in the position illustrated in FIG. 1, in which journal stud 54 of the loading lever is in a contacting relationship with the rear end of slot 52, facing away from the direction of fire. Loading lever 51 is arranged next to magazine 31, and one end of the loading lever has a lateral shoulder 55 which is located in front of forwardmost cartridge 34 of magazine 31 in the above-described position, illustrated in FIG. 1. When speaking of the magazine and the cartridges contained therein, the expression "forward" refers to the direction of feed of the cartridges in the magazine, which is opposed to the direction of fire. The forwardmost cartridge is thus that cartridge which is ready to be introduced into the firing chamber.

The end of loading lever 51 opposed to shoulder 55 has an arm 56, which operates conjointly with a cam 57 on slide 41, which serves to swivel breech member 4. Cam 57 has a straight section 58, upon which arm 56 of loading lever 51 rests in the indicated position and which extends parallel to the direction of travel of slide 41. Arranged on the front end of straight section 58 is a nose 59 having a flank 60 which rises from straight section 58 and a forward end surface 61 which is perpendicular to the direction of movement.

As long as arm 56 of loading lever 51 rests on straight section 58 of control cam 57, it is retained in a center position of rest, which is illustrated in FIG. 1. As mentioned above, this is the position in which a shot can be fired. When a shot is fired, slide 41 is moved rearwardly under the influence of the powder gases which develop therefrom. In this connection, nose 59 of cam 57 passes by arm 56 of loading lever 51, causing loading lever 51 to first perform a brief clockwise swivel motion before it is released by nose 59 of cam 57 and can then be swivelled counterclockwise by elbow spring 62 without hindrance. This lifts shoulder 55 on loading lever 51 so far that is positioned behind the end of forwardmost cartridge 34. If slide 41 is then moved back into the initial position shown in FIG. 1 by means of a spring which is tensioned by its return movement, for example, end surface 61 first comes into a contacting relationship with arm 56 of loading lever 51. The arrangement is designed in such a manner and elbow spring 62 is dimensioned in such a manner that loading lever 51 is first pushed into slot 52 without being swivelled. This guides shoulder 55 from its lateral position next to forwardmost cartridge 34 into a position in which it engages said forwardmost cartridge from behind. When journal stud 54 has come into a contacting relationship with the front end, in the direction of fire, of slot 52, the end surface causes loading lever 51 to swivel clockwise, thereby moving shoulder 55 of the loading lelvel toward breech member 4. During this sequence, shoulder 55 drives forwardmost cartridge 34 out of the magazine and inserts it into the firing chamber in the breech member, which is placed in the loading position during the rearward movement of slide 41. The height of nose 59 is dimensioned in such a manner as to ensure complete insertion of the cartridge. When arm 56 of loading lever 51 has reached the crown of nose 59, it is released longitudinally and can therefore be moved rearwardly to its initial position again by elbow spring 62. However during this sequence the loading lever still remains swivelled clockwise relative to the position illustrated in FIG. 1. However lateral shoulder 55 assumes the attitude illustrated in FIG. 1 relative to magazine 31, thereby permitting unimpeded advance of the next cartridge into the forwardmost position at this time. Moreover, it can swivel into the position of rest illustrated in FIG. 1 without hindrance through the magazine and the forwardmost cartridge when arm 56 slides along inclined flank 60 of cam 57 as slide 41 continues moving forward. The above described cycle is repeated with every shot.

In the illustrated weapon, the movement of slide 41 is further utilized to actuate a shot counter 71, which operates conjointly with the trigger mechanism in an unillustrated manner. For this purpose, the slide has an arm 72, which comes into engagement with a switching member of the shot counter every time the slide moves back and forth. Moreover, the slide can also serve to cock hammer 26 of the trigger mechanism in an unillustrated manner. It is practical to design the trigger mechanism in such a manner that after every shot it catches slide 41 in a rearward position, in which hammer 26 is cocked, breech member 4 is in the loading position and loading lever 51 is positioned to the side of and behind forwardmost cartridge 34. When trigger 28 is pulled, slide 41 is then released, permitting it to move to its forwardmost position, whereby it first shifts loading lever 51 forwardly in the above-described manner, then swivels it for the introduction of a cartridge into breech member 4, then swivels the breech member into the firing position, and finally releases the hammer for ignition of the cartridge. After ignition, the above-mentioned parts are then returned to the initial position in the above-described manner. This behaviour corresponds to that of an open-bolt weapon, and offers the advantage that there is no cartridge in the closed firing chamber with the weapon in a state of rest. Especially with caseless cartridges, it would otherwise be quite possible for a weapon that has been heated up from firing to result in spontaneous ignition of a cartridge located in the firing chamber if, as is common in the case of closed-bolt weapons, the cartridge has been ready to fire in the closed firing chamber for an extended period of time.

When stub 44 on the end surface of breech member 4 travels through V-shaped transition 47 of control slot 43 in slide 41, the breech member briefly assumes a defined position located between the firing position and the loading position. In the illustrated practical example, this intermediate position is employed as an ejection position, which can be required, for example, for ejecting cartridges which fail to fire as a result of an ammunition defect. In this intermediate position, in which breech member 4 is swivelled 45° relative to the firing position illustrated in FIGS. 1 and 2, the firing chamber is in alignment with a passage 81 in member 2; passage 81 is then adjacent to front section 6 of the firing chamber. This passage serves as a guide for an ejector which, in the simplest manner, can be a rod which is attached to the rifle in such a manner that it can be removed and inserted into this passage. In the illustrated practical example the tube 82 which follows passage 81 contains a ram 83 which is attached to the front end of a spiral hose 84 guided in said tube. Spiral hose 84 can be slid within tube 82 together with ram 83 through unillustrated means and, with the breech member in the ejection position, can be pushed through the firing chamber. That side of member 2 facing away from passage 81 has a recess 85 into whose area the rear end of the firing chamber in breech member 4 opens, so that the rear end of the firing chamber is also free for the ejection of a cartridge. Magazine 31 with cartridges 32 and shoulder 55 of loading lever 51 also engage this recess. The loading lever has already reached the position illustrated in FIG. 1 when breech member 4 has been swivelled 45°into the above-described ejection position, so that shoulder 55 of the loading lever does not cover the rear end of the firing chamber in the breech member when the breech member is in the ejection position and, consequently, does not prevent the ejection of a cartridge, as would be the case if it were left in that position which it assumes immediately after the introduction of a cartridge, i.e. in which shoulder 55 is located directly adjacent to the periphery of breech member 4. The purpose of straight section 58 of cam 57 is thus to temporarily bring loading lever 51 into an intermediate position, in which it does not hinder the ejection of a cartridge from the firing chamber. Nevertheless, care has been taken to ensure that loading lever 51 does not have to travel excessive distances and complicated switching means do not have to be provided in order to move the loading lever differently when slide 41 moves forward or backward. It is obvious that an intermediate position of the breech member would also have to be provided if the arrangement according to the present invention were to be employed with autoloading weapons utilizing case-type cartridges, in order to permit ejection of the empty cartridge cases.

Obviously, many modifications and variations of the present invention are possible in the light of the above teachings. It should therefore be understood that within the scope of the appended claims, the invention may be practiced otherwise than a specifically described.

Having thus fully disclosed our invention, what we claim is:

1. A shoulder arm having a rigidly attached barrel and capable of firing a cartridge having a primer, especially a rifle, the shoulder arm having a breech member which can be swivelled about an axis which is perpendicular to the axis of the barrel for loading and which contains a firing chamber which is in alignment with said barrel in its firing position in which it is fully closed to the rear, further having a firing pin which upon triggering hits the primer of the cartridge to be fired by the fire arm, further having an arrangement for swivelling said breech member out of said firing position and into a loading position, in which said firing chamber is accessible for the introduction of the cartridge, in which said breech member is designed as a roller which can be swivelled about its longitudinal axis and which is arranged in a cylindrical hole in a member which is fixedly attached to said barrel and whose wall directly closes said firing chamber when it is located in the firing position, said roller being retained in its respective position by means of the arrangement for swivelling said breech member.

2. The shoulder arm set forth in claim 1, in which the axis of said firing chamber intersects the axis of said roller which forms said breech member.

3. The shoulder arm set forth in claim 1, in which said firing chamber is designed for receiving caseless cartridges and the area for receiving the propellant body has a wider rear section, in which is inserted a sealing sleeve whose inwardly extending flange is in a contacting relationship with the wall of said member which is fixedly attached to said barrel.

4. The shoulder arm set forth in claim 3, in which a firing pin, pointing at right angles to the axis of said firing chamber, is arranged in said area of said breech member which serves to receive said propellant body.

5. The shoulder arm set forth in claim 1, in which said breech member can be swivelled into an ejection position, in which the rear end of said firing chamber is free and the front end is opposite a passage for an ejector, said passage being located in said member which is fixedly attached to said barrel.

6. The shoulder arm set forth in claim 1, in which said arrangement for swivelling said breech member comprises a slide capable of occupying a plurality of positions which is arranged in the longitudinal direction of the weapon and which engages said breech member positively in each of the positions of said slide.

7. The shoulder arm set forth in claim 6, in which said breech member has an eccentric stub on at least one end surface of said roller, said stub engaging a control slot in said slide.

8. The shoulder arm set forth in claim 7, in which said control slot has two end sections extending parallel to its direction of movement, one of said end sections defining the firing position and the other of said end sections defining the loading position, each of said end sections being connected one with the other by means of a transition which causes said breech member to rotate.

9. The shoulder arm set forth in claim 8, in which in the loading and firing positions, said stub of said breech member assumes one respective position of two preferably symmetrically located positions in the direction of travel of said slide, located on both sides of the perpendicular extending through the swivel axis of said roller, and said transition between the two said end sections is designed as a vee.

10. The shoulder arm set forth in claim 6 in which said slide is connected with drive means which are actuated by gas pressure.

11. The shoulder arm set forth in claim 10, in which said drive means operate conjointly with the trigger mechanism in the nature of an open-bolt weapon.

12. The shoulder arm set forth in claim 1, in which, in the loading position, said breech member is swivelled at least almost 90°relative to the firing position, and there is a magazine in which the cartridges are arranged perpendicular to the direction of fire and in which the respective forwardmost cartridge is located opposite said firing chamber when said breech member is located in the loading position.

13. The shoulder arm set forth in claim 12, in which said magazine is a box-type magazine arranged above said barrel and parallel thereto.

14. The shoulder arm set forth in claim 12 in which a loading lever is pivotally mounted about an axis which is parallel to the swivel axis of said breech member, a shoulder of said loading lever engaging said respective forwardmost cartridge in said magazine from behind in one position and pushing said cartridge out of said magazine and into said breech member, located in the loading position, by means of a swivel motion.

15. The shoulder arm set forth in claim 6, in which, in the loading position, said breech member is swivelled at least almost 90°relative to the firing position, and there is a magazine in which the cartridges are arranged perpendicular to the direction of fire and in which the respective forwardmost cartridge is located opposite said firing chamber when said breech member is located in the loading position; and in which a loading lever is pivotally mounted about an axis which is parallel to the swivel axis of said breech member, a shoulder of said loading lever engaging said respective forwardmost cartridge in said magazine from behind in one position and pushing said cartridge out of said magazine and into said breech member, located in the loading position, by means of a swivel motion.

16. The shoulder arm set forth in claim 15, in which said loading lever operates conjointly with a cam, said cam being connected with said slide which causes said breech member to swivel.

17. The shoulder arm set forth in claim 16, in which said loading lever is slidably arranged in its longitudinal direction and is subjected to the force of an elbow spring, which retains it in a position of rest, in which said shoulder is positioned both beside and behind said forwardmost cartridge in said magazine, and in which said cam on said slide pushes said loading lever out of the position of rest, against the force of said elbow spring, and first into that position in which said shoulder engages said forward most cartridge from behind before said cam swivels said loading lever to push said cartridge into said breech member and then releases said loading lever directly thereafter, permitting it to return to its position of rest, so that said shoulder of said loading lever passes by said forwardmost cartridge in said magazine as said loading lever swivels back into its position of rest.

18. The shoulder arm as set forth in claim 15, in which said loading lever operates conjointly with a cam, said cam being connected with said slide which causes said breech member to swivel, in which said loading lever is slidably arranged in its longitudinal direction and is subjected to the force of an elbow spring, which retains it in a position of rest, in which said shoulder is positioned both beside and behind said forwardmost cartridge in said magazine, and in which said cam on said slide pushes said loading lever out of the position of rest, against the force of said elbow spring, and first into that position in which said shoulder engages said forwardmost cartridge from behind before said cam swivels said loading lever to push said cartridge into said breech member and then releases said loading lever directly thereafter, permitting it to return to its position of rest, so that said shoulder of said loading lever passes by said forwardmost cartridge in said magazine as said loading lever swivels back into its position of rest.

19. The shoulder arm set forth in claim 18, in which the ejection position of said breech member is located between the loading and the firing positions, and, when said breech member is located in the ejection position, said loading lever assumes an intermediate position, in which said shoulder thereof is located outside of the path of a portion of said cartridge which is to be ejected.

* * * * *